US005787661A

United States Patent [19]

Sharp

[11] Patent Number: 5,787,661

[45] Date of Patent: Aug. 4, 1998

[54] BUILDING SIDING SYSTEM

[76] Inventor: Robert Y. Sharp, P.O. Box 180, Marlington, W. Va. 24954-0180

[21] Appl. No.: 837,187

[22] Filed: Apr. 14, 1997

[51] Int. Cl.[6] ..... E04B 1/12

[52] U.S. Cl. ..... 52/233; 52/284; 52/286; 52/542; 52/554; 52/745.1; 52/745.13; 52/747.1; 52/748.1

[58] Field of Search ..... 52/233, 284, 286, 52/519, 542, 554, 748.1, 747.1, 745.1, 745.13

[56] References Cited

U.S. PATENT DOCUMENTS

| | | | |
|---|---|---|---|
| 3,863,409 | 2/1975 | Fell . | |
| 4,056,906 | 11/1977 | Elfström . | |
| 4,126,977 | 11/1978 | Chisum . | |
| 4,320,610 | 3/1982 | Rupp . | |
| 4,745,722 | 5/1988 | Ross | 52/233 |
| 4,840,003 | 6/1989 | Lucas et al. | 52/233 |
| 4,967,526 | 11/1990 | Yost . | |
| 5,103,610 | 4/1992 | Walters | 52/233 |
| 5,103,728 | 4/1991 | Halsley, Jr. et al. . | |
| 5,181,358 | 1/1993 | Mead | 52/233 |
| 5,423,153 | 6/1995 | Woolems et al. . | |
| 5,586,422 | 12/1996 | Hoffner | 52/233 X |
| 5,638,649 | 6/1997 | Hovland | 52/233 |

*Primary Examiner*—Christopher Kent
*Attorney, Agent, or Firm*—Spencer D. Conard

[57] ABSTRACT

A simulated log cabin structure, corner assembly and method are provided having advantages over conventional simulated log cabin structures. The structure has (i) a substrate wall layer, preferably an insulative board layer, (ii) spaced apart horizontal outer board layers, (iii) a mortar layer adhered to the substrate wall between the board layers, and (iv) a corner assembly having interconnecting alternating blocks. The structure may be quickly constructed by a method comprising (a) attaching insulative board to the exterior of a building frame, (b) applying mortar to the insulative board, (c) attaching horizontal boards to the frame in a spaced apart fashion to permit the mortar to be visible between the boards. The structure also has a corner assembly having interconnecting notched blocks having interior curved abutment faces for restricting horizontal movement of the blocks. The structure and method combine simplicity with reduced wood requirements and relatively light weight to produce a simulated notch and mortar type wood cabin appearance structure. A two tone vinyl siding may be employed to yield a log home appearance for individuals desiring vinyl siding.

2 Claims, 3 Drawing Sheets

BUILDING SIDING SYSTEM

BACKGROUND OF THE INVENTION

1. Field of the Invention

The present invention relates to siding systems for buildings, and more particularly relates to simulated log siding systems for buildings.

2. Description of the Related Art

Building structures with simulated external log cabin corner joint units are known, see for example Yost U.S. Pat. No. 4,967,526 issued Nov. 6, 1990, Halsey, Jr et al U.S. Pat. No. 5,010,701 issued Apr. 30, 1991, Rupp U.S. Pat. No. 4,320,610 issued Mar. 23, 1982, and Elfstrom U.S. Pat. No. 4,056,906 issued Nov. 8, 1977, all of which are incorporated herein by reference; and various other log cabin systems and simulations are disclosed including Fell U.S. Pat. No. 3,863, 409 issued Feb. 4, 1975, Chisum U.S. Pat. No. 4,126,977 issued Nov. 28, 1978, and Woolems et al U.S. Pat No. 5,423,153 issued Jun. 13, 1995 all of which are incorporated herein by reference. The systems however apparently suffer from one of more of the following problems, specifically, (a) high wood content, (b) lack of wood log type corner appearance (lack of notched appearance, etc), (c) somewhat complex or labor intensive construction techniques or (d) lack of grout filler appearance.

Consequently, there is an need and desire for a construction structure and method for producing a simulated log cabin structure with a relatively reduced wood content, a notched wood log corner appearance, a relatively simple construction technique and with a mortar/grout spacing appearance.

SUMMARY OF THE INVENTION

The present invention involves a simulated log cabin structure comprising (i) a substrate wall layer, preferably an insulative board layer, (ii) spaced apart horizontal outer board layers, (iii) a mortar layer adhered to the substrate wall between the board layers, and (iv) a corner assembly comprising interconnecting alternating blocks (concealed interlocking end blocks). The structure may be quickly constructed by a method comprising (a) attaching insulative board to the exterior of a building frame, (b) applying mortar to the insulative board, (c) attaching horizontal boards to the frame in a spaced apart fashion to permit the mortar to be visible between the boards. The structure also has a corner assembly comprising interconnecting notched blocks having interior curved abutment faces for restricting horizontal movement of the blocks. The structure, assembly and method combine simplicity with reduced wood requirements and relatively light weight to produce a simulated notch and mortar type wood cabin appearance structure. Optionally, if vinyl siding is desired, the a two toned siding having a narrow grey upper strip section and a lower brown wide plank section may be employed to achieve a desired log home appearance.

DETAILED DESCRIPTION OF THE INVENTION

Figure 4:
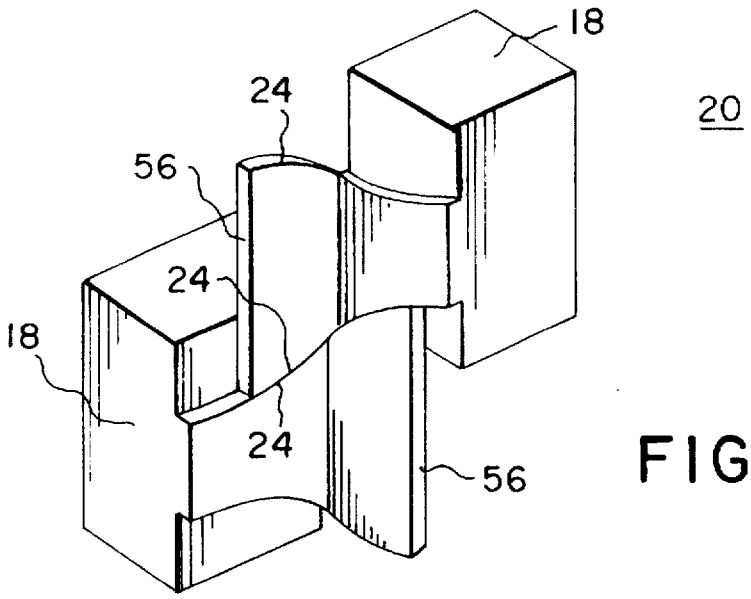
FIG. 4 is a pair of alternating interconnecting elements of the present invention.
Figure 5:
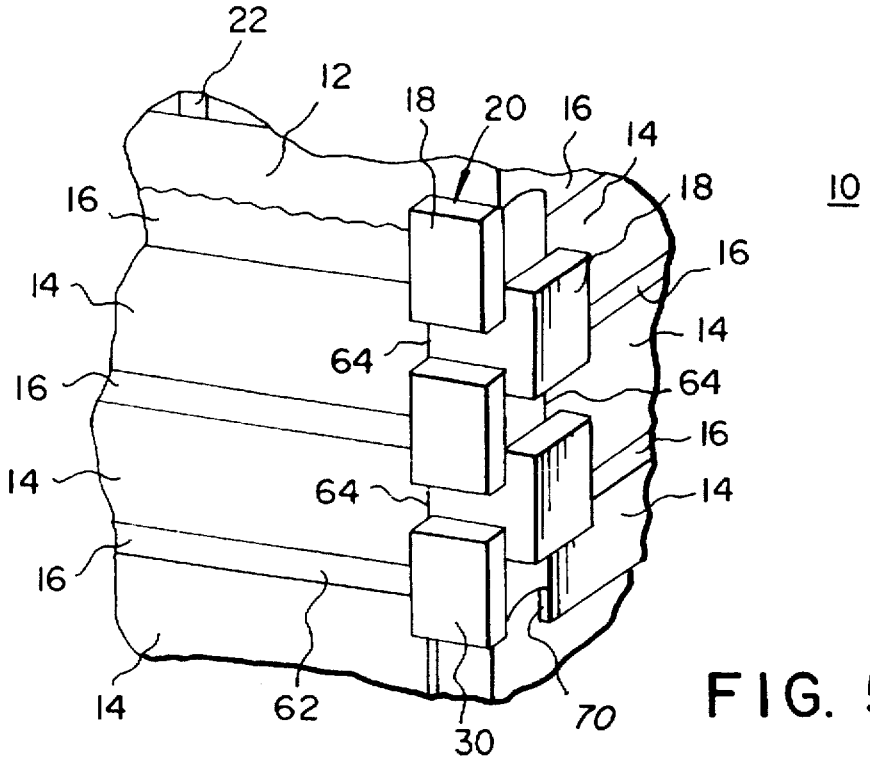
FIG. 5 s a cutaway perspective view of a corner of a structure having the corner assembly and siding of the sent invention.

As best shown in FIG. 5, a simulated log cabin structure (10) comprising (i) a substrate wall layer (12), preferably in the form of an insulative sheet layer (12), (ii) spaced apart horizontal outer board layers (14), (iii) a mortar layer (16) adhered to the substrate wall (12) between the board layers (14), and preferably (iv) a corner assembly (20) comprising interconnecting alternating blocks (18). The structure (10) may be quickly constructed by a method comprising (a) attaching insulative sheet (12) to the exterior of a building frame (22), (b) (selectively) applying mortar (16) to the insulative sheet layer, (c) attaching horizontal boards (14) to the frame (22)in a vertically spaced apart fashion to permit the mortar (16) to be visible (in the spaces) between the boards (14). As best shown in FIG. 4, the corner assembly (20) comprises interconnecting notched blocks (18) having interior curved abutment faces (24) for restricting horizontal movement of the blocks (18) when assembled. The structure (10) and method combine simplicity with reduced wood requirements and relatively light weight to produce a simulated notch and mortar type wood cabin appearance structure (10).

Figure 1:
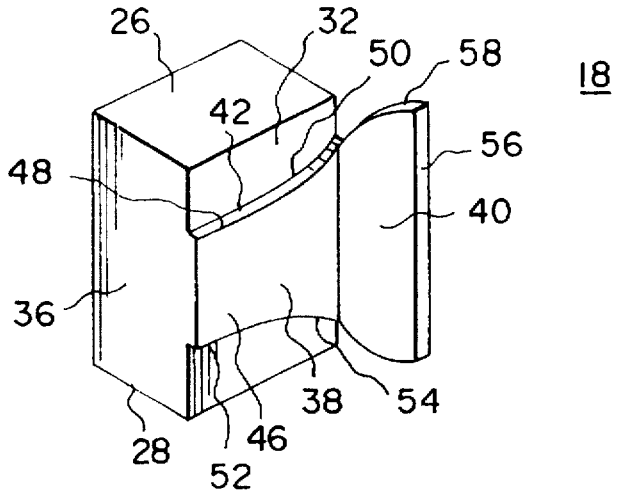
FIG. 1 is a perspective view of a corner element accord to the present invention.
Figure 2:
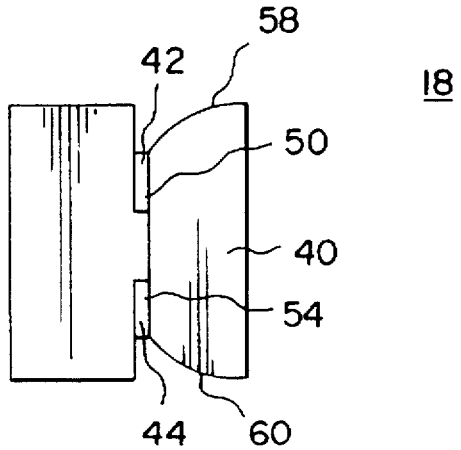
FIG. 2 a left side elevation view of the corner element of FIG. 1.
Figure 3:
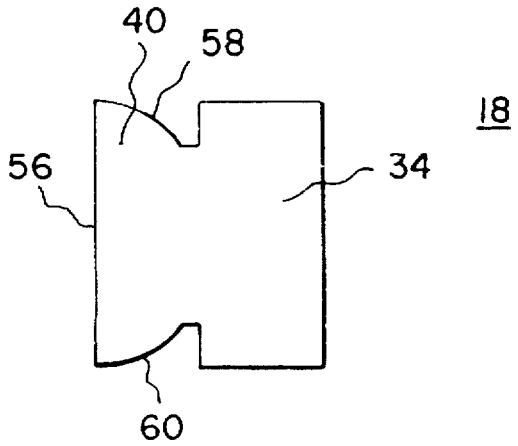
FIG. 3 is a right side elevational view of the corner element of FIG. 1.

The corner assembly (20) of the present invention provides an interlocking structure which resists decoupling when assembled. Each block (18) has a box shaped head (26) having a rectangular sides (26–36), specifically a rectangular top side (26), a rectangular bottom side (28), a rectangular front side (30), a rectangular rear side (32), a rectangular right side (34) and a rectangular left side (18). An abutment element (38) extends rearwardly from the rear side (32). The abutment element (38) has a curvalinear shape widening as it extends from the left side (36) to the right side (34). The abutment element (38) is vertically centered on the rear side (32) of the block (18) and at the left side of the block (18) preferably has a height of about a third of the height of the block (18), and at the right side of the block has a height of approximately two thirds of the height of the block. The abutment element (38) has a top face (42), a bottom face (44) and a rear face (46). The top face (42) has a horizontal portion (48) extending (about a third of the way across the block) from the left side (36) and then has an upwardly curving (concave) portion (50) extending from the horizontal portion (48) to the right side (34), and the bottom face (44) has a horizontal portion (52) extending (about a third of the way across the block) from the left side (36) and then has a downwardly curving (concave) portion (54) extending from the horizontal portion to the right side (34). An interconnecting (interlocking) element (40) extends rearwardly from the right side (34) of the abutment element and is preferably flush with the right side (34). The interconnecting element (40) is designed to fit between the abutment element of the block above it and the abutment element of the block beneath it thereby locking the block in position between the block above it and the block beneath it (the blocks are alternated vertically between two 90 degree offset positions). The interconnecting element (40) is preferably has the thickness of a board (14) and at it rearmost vertical edge (56) has the height of a board (14) for seamless abutment with a board (14) during construction. The interconnecting element (40) has an upper face (58) which curves (convexly) from the abutment element rearwardly to the top of edge (40), and has a lower face (60) which curves (convexly) from the abutment element rearwardly to the bottom of edge (40). The interconnecting element widens rearwardly from the height of the right abutment element at the right side of the block to the height of the board (14). FIGS. 1, 2 and 3 shown various views of the blocks (18).

As best shown in FIG. 5, the various component of the structure are shown in assembled and partially assembled stages. The structure (10) have conventional steel or wood frame construction as the underlying skeletal framework as shown by the wood stick (2×4 or 2×6) frame (22). The frame (22) has the sheet (12) (plywood or insulative) attached thereto which functions as a substrate for the mortar (16) and siding (14). At least some of the blocks (18) are stacked in alternating fashion (between two 90 degree offset positions) to at least partially construct the corner assembly (20). The mortar (16) (other grey coloration material may less preferably be used such as paint or grey tape; mortar is preferred due to its weatherability and its appearance) is adhered to the substrate (12) by direct application thereto. The amount of mortar (16) applied may be minimized by utilizing only a thin layer (for example less than 0.20 inches thick) of mortar (cement) (16) and by using the mortar in vertically spaced apart horizontal patches just sufficient to cover the space (62) between adjacent boards (14).

The boards (14) may then attached to the frame (22) and are positioned in spaced apart fashion so that the ends (70) of the boards abut respective rear edges (56) of respective blocks (18). The abutment is shown as a fine abutment line (64) which would not be readily visible if there is tight connection between the board (14) and the block (18).

A suitable board (14) may have a height 9.5" and a thickness of three quarters of an inch, and a length of eight feet. Depending on the desired appearance boards (14) may have heights selected from 6 to 18 inches and widths of 0.25 to 1.5 inches and lengths of 4 to 12 feet. A series of boards may be aligned horizontally to provide the desired total length. Attachment of the substrate and boards to the frame may be done by nails or other suitable means.

A suitable block (14) has a height of 9.5 inches, a head depth of 3.5 inches, a head width of 5 inches; and a suitable interconnecting element has a depth of 4.25 inches and a width of 0.75 inches.

Figure 6:
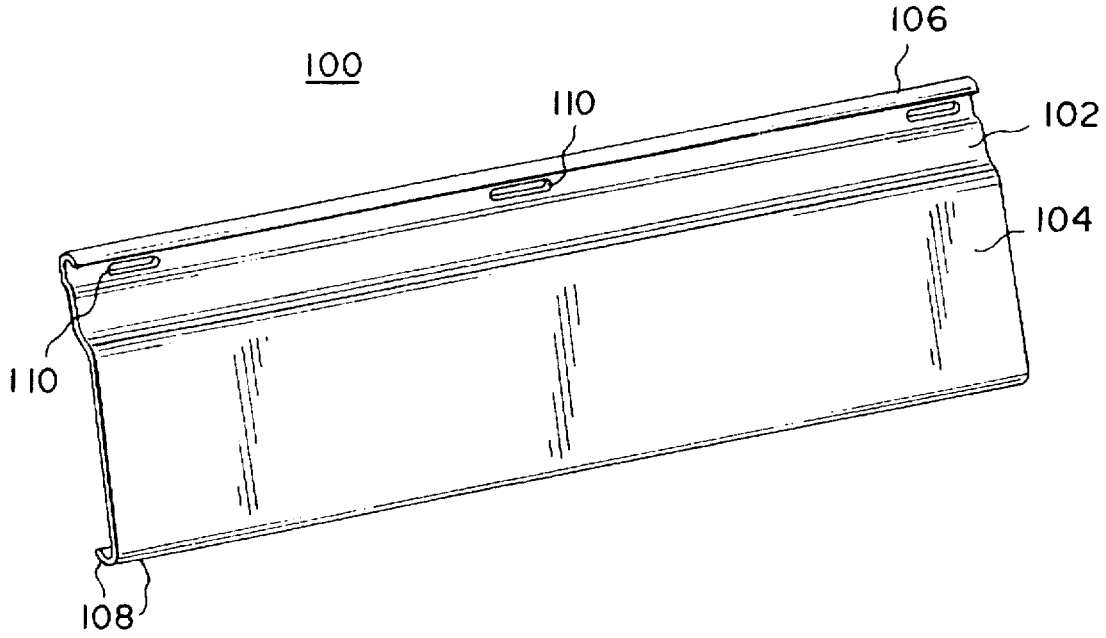
FIG. 6 is perspective view of a vinyl siding according to the present invention.
Figure 7:
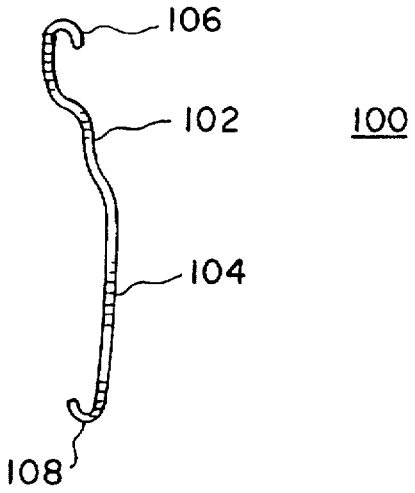
FIG. 7 is a side elevational view of an end of the siding of FIG. 6.

For individuals desiring the use of vinyl siding, the end blocks of the present invention may be used with a two tone vinyl siding (100) as best shown in FIGS. 6 and 7. The siding (100) has a narrow grey upper strip section (102) and a wide brown lower plank section (104). The narrow upper grey strip section is used to simulate the appearance of mortar and the lower plank section is used to simulate a wood log (wood plank). The plank section (104) extends forward from the strip section (102) to simulate a mortar and plank contour. The upper section (102) has a downwardly open frontwardly extending J-hook (106), and the bottom section (104) has a rearwardly extending upwardly open j-hook (108). The upper section (102) also has a plurality of nail receiving slots (110) for permitting the siding (100) to be nailed to the side of a building, and the horizontal orientation of the slots (110) permits some expansion and contraction of the siding relative to the fixed nail positions. For installation, a siding (110) may be nailed to the outside of a building and a second siding piece may be affixed at its bottom by hooking the bottom j-hook (108) of the second siding to the upper j-hook of the first panel, followed by nailing the second siding panel to the outside of the building. The siding may be made by coextrusion processes well known in the siding industry (such as coextrusion of ASA copolymeric materials on PVC substrates), and may be made by coextruding a two tone (grey and brown) cap layer (polyvinyl chloride (PVC) over a PVC substrate to yield the desired contour and coloration pattern.

What is claimed is:

1. A corner assembly for a building structure having a simulated log home appearance, said assembly comprising:

(a) a plurality of interconnecting blocks, each block comprising (i) a head, (ii) an abutment element extending rearwardly from said head, and (iii) an interconnecting element extending rearwardly from said head on one side of said abutment element, said abutment element increasing in width from one side on said head to said interconnecting element, said interconnecting element increasing in width rearwardly from the rear of said head, said abutment element and said interconnecting element being shaped to be in matching engagement in said assembly.

2. A method for constructing a simulated log home structure, said method comprising:

(a) providing a structural building frame, (b) attaching a substrate to said frame, (c) applying a mortar compound to said substrate, (d) attaching horizontal boards to said frame adjacent said substrate such that said boards are vertically spaced apart from vertically adjacent boards, said mortar covering the substrate located between adjacent boards.

* * * * *